US010058969B2

(12) United States Patent
Eberhardt

(10) Patent No.: US 10,058,969 B2
(45) Date of Patent: Aug. 28, 2018

(54) DUAL-SPINDLE GRINDING MACHINE

(71) Applicant: EMAG Holding GmbH, Salach (DE)

(72) Inventor: Armin Eberhardt, Amstetten-Schalkstetten (DE)

(73) Assignee: EMAG HOLDING GMBH, Salach (DE)

( * ) Notice: Subject to any disclaimer, the term of this patent is extended or adjusted under 35 U.S.C. 154(b) by 127 days.

(21) Appl. No.: 15/159,884

(22) Filed: May 20, 2016

(65) Prior Publication Data

US 2016/0346894 A1 Dec. 1, 2016

(30) Foreign Application Priority Data

May 30, 2015 (DE) ..... 10 2015 007 023

(51) Int. Cl.

| | |
|---|---|
| ***B24B 27/00*** | (2006.01) |
| ***B24B 5/04*** | (2006.01) |
| ***B24B 41/02*** | (2006.01) |
| ***B24B 41/04*** | (2006.01) |
| ***B24B 5/35*** | (2006.01) |
| ***B24B 41/00*** | (2006.01) |
| ***B24B 53/053*** | (2006.01) |

(52) U.S. Cl.

CPC ..... *B24B 5/042* (2013.01); *B24B 5/04* (2013.01); *B24B 5/355* (2013.01); *B24B 27/0023* (2013.01); *B24B 27/0076* (2013.01); *B24B 41/005* (2013.01); *B24B 41/02* (2013.01); *B24B 41/04* (2013.01); *B24B 53/053* (2013.01)

(58) Field of Classification Search

CPC ..... B23Q 39/026; B23Q 2039/002; B24B 5/042; B24B 5/355; B24B 13/0031; B24B 25/00; B24B 27/0023; B24B 27/0069; B24B 27/0076; B24B 41/005; B24B 41/02; B24B 53/053

See application file for complete search history.

(56) References Cited

U.S. PATENT DOCUMENTS

| | | | | |
|---|---|---|---|---|
| 4,718,196 | A * | 1/1988 | Seewald | B24B 53/053 125/11.03 |
| 8,082,643 | B2 * | 12/2011 | Hegener | B23Q 39/028 29/27 C |
| 8,448,550 | B2 * | 5/2013 | Hessbrueggen | B23B 3/30 82/122 |
| 8,864,552 | B2 | 10/2014 | Schmitz | |
| 9,211,621 | B2 * | 12/2015 | Hessbrueggen | B23Q 39/02 |
| 2010/0233939 | A1 * | 9/2010 | Schmitz | B24B 19/12 451/49 |
| 2012/0009851 | A1 * | 1/2012 | Schmitz | B24B 19/125 451/73 |
| 2013/0267151 | A1 * | 10/2013 | Bando | B24B 9/102 451/69 |
| 2017/0050286 | A1 * | 2/2017 | Hegener | B24B 5/42 |

* cited by examiner

*Primary Examiner* — Timothy V Eley
(74) *Attorney, Agent, or Firm* — Andrew Wilford

(57) ABSTRACT

A grinding apparatus has a support frame and first and second carriages horizontally displaceable on the frame. Respective first and second workpiece spindles are each capable of holding and rotating a workpiece and are vertically displaceable on the first and second carriages. Respective first and second grinders on the frame carry respective first and second grinding wheels and are oriented to engage and machine workpieces held and rotated by the workpiece spindles. One of the grinders is movable horizontal or vertically on the frame.

11 Claims, 3 Drawing Sheets

DUAL-SPINDLE GRINDING MACHINE

FIELD OF THE INVENTION

The present invention relates to a grinding machine. More particularly this invention concerns such a machine having dual workpiece spindles and dual grinders.

BACKGROUND OF THE INVENTION

U.S. Pat. No. 8,864,552 discloses such a machine for grinding a cam having an outer surface with outwardly convex and outwardly concave portions. The machine has a frame and means on the frame for holding the cam and rotating it about a main axis. A pair of drive motors have respective output axes generally diametrally flanking the main axis and are carried on respective carriages shiftable on the frame radially of the main axis. One of the motors is shiftable into an inner position in which the main axis extends through the one drive motor. Respective grinding wheels are rotatable by the motors about the respective axes. The wheel of the one motor is of substantially smaller diameter than the wheel of the other motor and also of smaller diameter than the one motor. In addition the grinding wheels are, relative to the main axis, axially between the drive motors.

OBJECTS OF THE INVENTION

It is therefore an object of the present invention to provide an improved such apparatus.

Another object is the provision of such an improved such apparatus that overcomes the above-given disadvantages, in particular that has a shorter cycle time for finishing workpieces at a higher rate.

SUMMARY OF THE INVENTION

A grinding apparatus has according to the invention a support frame and first and second carriages horizontally displaceable on the frame. Respective first and second workpiece spindles are each capable of holding and rotating a workpiece and are vertically displaceable on the first and second carriages. Respective first and second grinders on the frame carry respective first and second grinding wheels and are oriented to engage and machine workpieces held and rotated by the workpiece spindles. One of the grinders is movable horizontal or vertically on the frame.

This machine can operate on the pick-up principal and can be used either to alternately machine workpieces on one side while the other side is being reloaded. Alternately the two sides of the machine can operate independently of each other.

Normally according to the invention the one grinder is movable vertically on the frame. Furthermore the first and second carriages are displaceable into a position with respective workpieces both engaged simultaneously by one of the grinding wheels.

In another system according to the invention there is a third such grinder on the frame.

Both of the grinders can be shiftable horizontally on the frame. In addition the apparatus can have a tailstock alignable with one of the first and second workpiece spindles, with at least one of the grinders movable both vertically and horizontally on the frame. Alternately there are respective first and second tailstocks fixed on the frame and alignable with the first and second workpiece spindles, and a slide carrying the first and second grinders and movable vertically and horizontally on the frame.

In another apparatus according to the invention there are third and fourth grinders carried on the frame and oriented to engage and machine workpieces held and rotated by the workpiece spindles. Two of the grinders are movable horizontally on the frame, and another two are movable vertically thereon.

The apparatus can have at least one dressing device engageable with the wheel of at least one of the grinders.

With the inventive apparatus normally one of the wheels is of smaller diameter than the other of the wheels and has an edge with a smaller radius of curvature than the other of the wheels.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
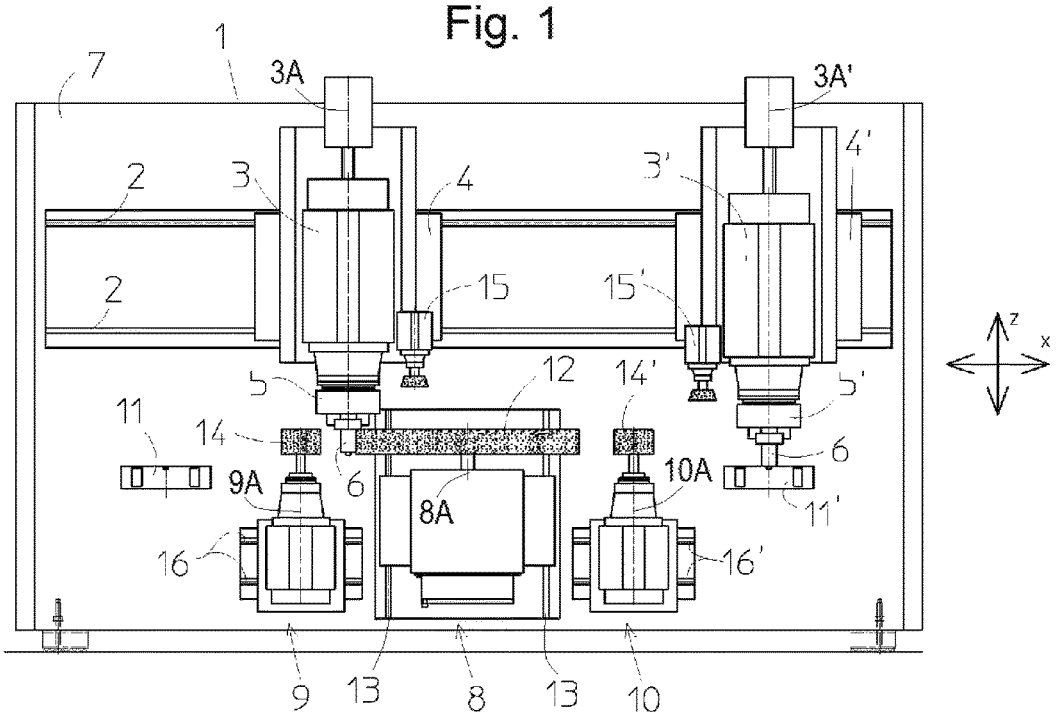
FIG. 1 is a partly schematic front view of a first embodiment of the apparatus according to the invention.
Figure 2:
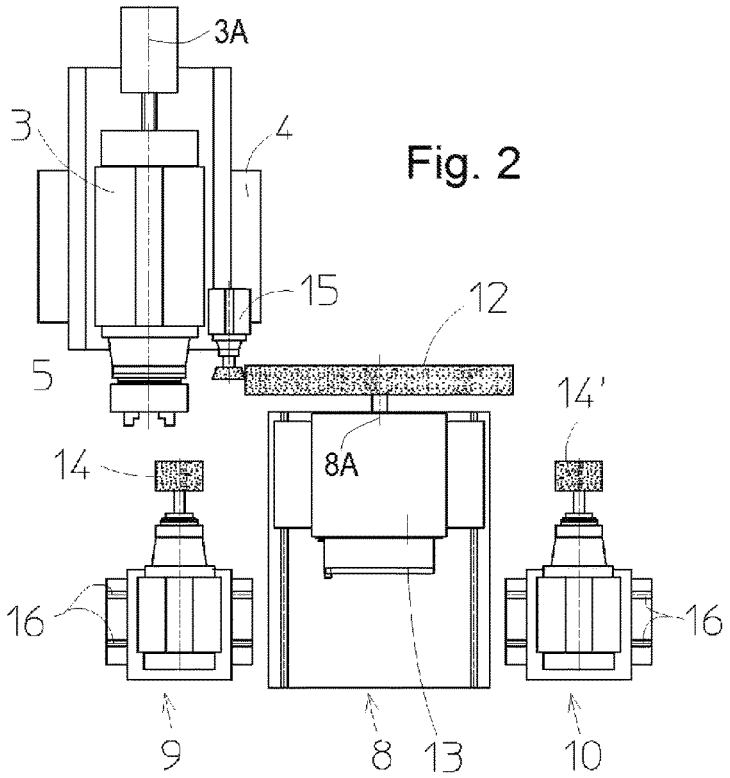
FIG. 2 is a large-scale view of a detail of FIG. 1.

As seen in FIGS. 1 and 2 an apparatus 1 according to the invention has a front wall 7 lying in a plane parallel to vertical and horizontal directions x and z.

Workpiece drive spindles 3 and 3' having respective chucks 5 and 5' holding respective workpieces 6 are vertically displaceable in the direction z on unillustrated guides on respective slides 4 and 4' that themselves are movable horizontally in the direction x on guide rails 2 fixed on the front wall 7. Thus these spindles 3 and 3' can move horizontally in the direction x and vertically in the direction z, and can rotate the respective workpieces 6 about respective vertical axes 3A and 3A'.

Generally below the workpiece drive spindles 3 and 3' are two outer grinders 9 and 10 carried and limitedly horizontally displaceable horizontally parallel to the direction x on respective guide rails 16 and 16' and carrying respective small-diameter cylindrical grinding wheels 14 and 14'. These grinders 9 and 10 rotate the respective small-diameter wheels 14 and 14' about respective axes 9A and 10A parallel to the axes 3A and 3A'.

Between the grinders 9 and 10 is a center grinder 8 that rotates a large-diameter grinding wheel 12 about another vertical axis 8A and that can move limitedly vertically on respective rails 13, but not horizontally. The diameter of the wheel 12 is substantially greater than the spindle drive 8 so that it projects radially well past it relative to the axis 8A. This makes it possible for the small-diameter wheels 14 and 14' to get particularly close to the workpieces 6 while they are diametrally oppositely engaged by the large-diameter wheel 12, for instance for machining concave surfaces on these workpieces 6. The axes 3A, 3A', 8', 9A, and 10A are parallel and coplanar and the various parts described above all move in this plane.

A pair of conveyors 11 and 11' flank the grinder 8, 9, and 10 in the direction x and allow unfinished workpieces 6 to be brought into the machine horizontally perpendicular to the directions x and z and then taken away when they are finished. Of course the spindles 3 and 3' can move to positions directly above the conveyors 11 and 11' in the direction z to pick up and drop off workpieces 6.

The provision of only a single wheel 12 does not decrease productivity, since the loading and unloading of a workpiece on one side can take place during the machining of a workpiece on the other side. Thus while, for instance, a workpiece 6 is being simultaneously machined on diametrally opposite sides by the wheel 12 and wheel 14, the other chuck 5' can be dropping off a finished workpiece 6', picking up an unfinished one, then moving the picked-up workpiece up and over into position to move down and be machined between the wheels 12 and 14' while the chuck 5 is unloading and reloading.

Alternately, the machine can simultaneously machine two workpieces 6 simultaneously, then unload and reload the chucks 5 and 5'. Either way, a high production rate is achieved with a single center wheel 2.

The spindle carriages 4 and 4' also carry respective dressing devices 15 and 15' that can renew the grinding wheels 12, 14, and 14'. To this end the spindles 3 and 3' are also vertically shiftable on the carriages 4 and 4' and themselves carry the dressing devices 15 and 15'. The dressing devices 15 and 15' are provided inward of the respective spindles 3 and 3', that is toward the other grinder 3 and 3', to allow dressing of the wheel 12 while keeping the wheel 12 spaced from the chucks 5 and 5' and workpieces 6.

FIG. 2 shows the center grinder 13 raised to allow the dresser 15 to true its outer surface. This vertical movability of the grinder 8 allows the dresser 15 on the spindle 3 to work on the wheel 12 without the wheel 14 engaging the chuck 5 or its workpiece 6.

Figure 3:
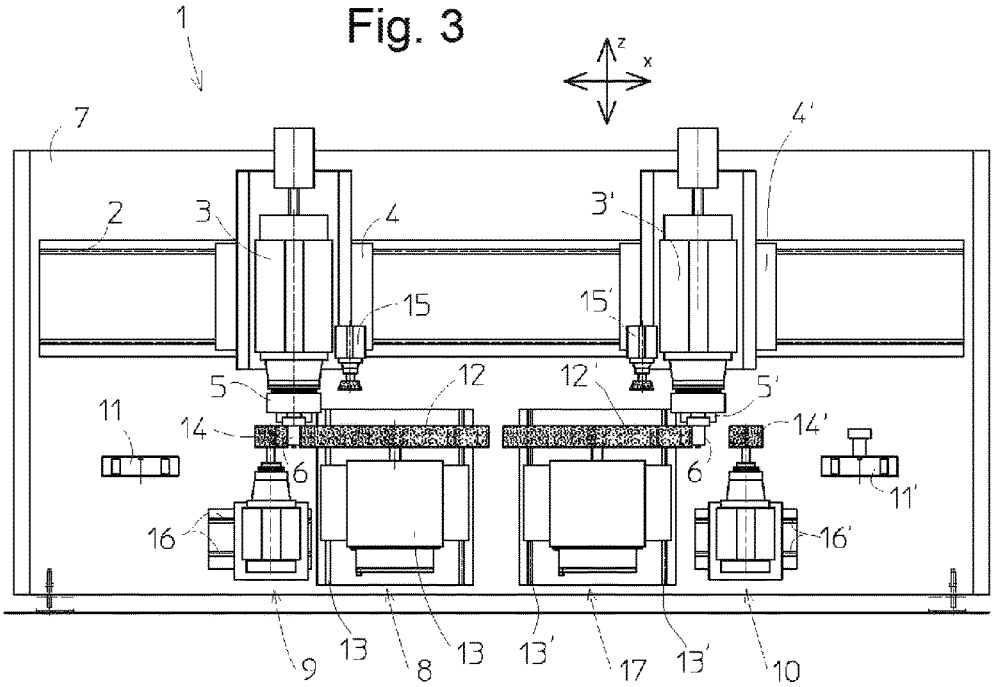
FIG. 3 is a view like FIG. 1 of a second embodiment with four grinders.

FIG. 3, where reference numerals from FIG. 1 are used for functionally or structurally identical elements, shows a system with a second center grinder 17 with a large-diameter wheel 12' and vertically replaceable on respective vertical guides 13'. This apparatus can machine two different workpieces in different manners at different rates, with one side working at a faster or slower rate than the other.

Figure 4:
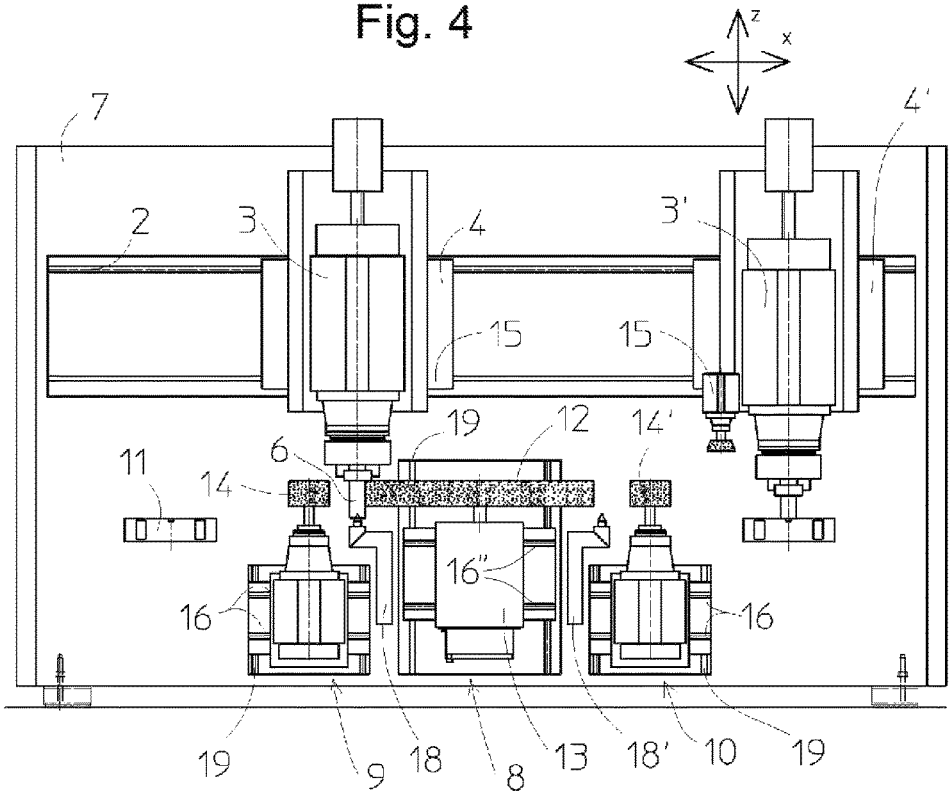
FIG. 4 is a view like FIG. 1 of the second embodiment equipped with tailstocks.

The system of FIG. 4 is much the same as that of FIG. 1, except that tailstocks 18 and 18 are provided that define work stations and that are used for machining elongated workpieces 6 or workpieces 6 that require extremely precise machining. Here the center grinder 8 is movable horizontally on guide rails 16" like the grinder 9 and 10, so that all the spindle drives 3, 3' and all the grinders 8, 9, and 10 can move both vertically and horizontally in the plane of the front wall 7.

Such tailstocks could also of course be provided for the system of FIG. 2, although this is not illustrated.

Figure 5:
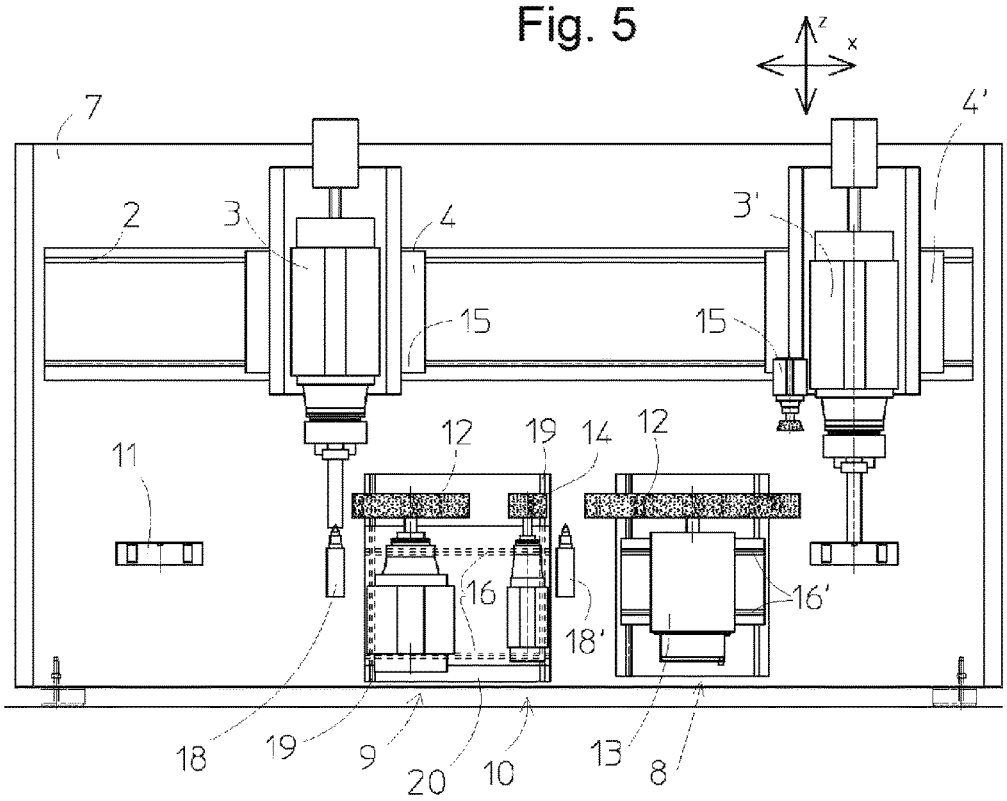
FIG. 5 is a view like FIG. 1 of a third embodiment with two grinders mounted on a single carriage.

FIG. 5 also has rotatable but stationary tailstocks 18 and 18', like FIG. 3, but here both grinders 9 and 10 are mounted on a common slide 20 for movement vertically jointly on guides 19 in the z direction and horizontally on the rails 16 in the x direction. Here a workpiece is first gripped in the chuck 5' of the spindle drive 3' and simultaneously machined between the wheels 12 and 14 of the grinders 8 and 10. Then the drive 3' moves to the grinder 9 for finishing. At the same time another workpiece can be held in the chuck 5 of the spindle 3.

I claim:

1. A grinding apparatus comprising:

a support frame;

first and second carriages horizontally displaceable on the frame;

respective first and second workpiece spindles each capable of holding and rotating a workpiece and vertically displaceable on the respective first and second carriages;

respective first and second grinders carried on the frame, carrying respective first and second grinding wheels, and oriented to engage and machine workpieces held and rotated by the workpiece spindles, one of the grinders being movable horizontal or vertically on the frame; and third and fourth grinders carried on the frame and oriented to engage and machine workpieces held and rotated by the workpiece spindles, two of the grinders being movable horizontally on the frame and another two being movable vertically thereon.

2. The grinding apparatus defined in claim 1, wherein the one grinder is movable vertically on the frame.

3. The grinding apparatus defined in claim 2, wherein the first and second grinders are both shiftable horizontally on the frame.

4. The grinding apparatus defined in claim 1, wherein the first and second carriages are displaceable into a position with respective workpieces both engaged simultaneously by one of the grinding wheels.

5. The grinding apparatus defined in claim 1, further comprising a third such grinder on the frame.

6. The grinding apparatus defined in claim 1, further comprising:

a tailstock alignable with one of the first and second workpiece spindles, oat least one of the grinders being movable both vertically and horizontally on the frame.

7. The grinding apparatus defined in claim 1, further comprising:

respective first and second tailstocks fixed on the frame and alignable with the first and second workpiece spindles; and a slide carrying the first and second grinders and movable vertically and horizontally on the frame.

8. The grinding apparatus defined in claim 1, further comprising:

at least one dressing device engageable with the wheel of at least one of the grinders.

9. The grinding apparatus defined in claim 1, wherein one of the wheels is of smaller diameter than the other of the wheels and has an edge with a smaller radius of curvature than the other of the wheels.

10. A grinding apparatus comprising:

an upright frame;

first and second carriages horizontally displaceable on the frame;

respective first and second spindle drives having respective first and second vertical rotation axes vertically displaceable on the first and second carriages and respective first and second chucks adapted to hold workpieces to be machined;

a center grinder carrying a large-diameter grinding wheel and vertically displaceable on the frame, the center grinder rotating the respective whe3e1 about a vertical axis;

first and second outer grinders carrying respective first and second small-diameter grinding wheels, flanking the center grinder, and horizontally displaceable on the frame; and third and fourth grinders carried on the frame and oriented to engage and machine workpieces held and rotated by the workpiece spindles, two of the grinders being movable horizontally on the frame and another two are movable vertically thereon.

11. The grinding apparatus defined in claim 10, further comprising:

intake and output conveyors flanking the grinders and spindle drives for moving the workpieces into and out of the apparatus.

* * * * *